US007000507B1

(12) United States Patent
Lin

(10) Patent No.: US 7,000,507 B1
(45) Date of Patent: Feb. 21, 2006

(54) HAND TOOL HAVING A JOINT LOCK MECHANISM

(75) Inventor: Yu-Cheng Lin, Taichung (TW)

(73) Assignee: Lea Way Hand Tool Corporation, Taichung (TW)

( * ) Notice: Subject to any disclaimer, the term of this patent is extended or adjusted under 35 U.S.C. 154(b) by 0 days.

(21) Appl. No.: 11/141,858

(22) Filed: Jun. 1, 2005

(30) Foreign Application Priority Data

Dec. 3, 2004 (TW) ..... 093219593

(51) Int. Cl.
*B25B 23/16* (2006.01)

(52) U.S. Cl. ..... 81/177.9; 81/177.8; 81/177.7

(58) Field of Classification Search ..... 81/177.9, 81/177.8, 177.7, 177.85
See application file for complete search history.

(56) References Cited

U.S. PATENT DOCUMENTS 6,000,302 A * 12/1999 Chiang ..... 81/177.8
6,216,567 B1 * 4/2001 Hu ..... 81/177.9
6,295,898 B1 10/2001 Hsieh
6,386,075 B1 * 5/2002 Shiao ..... 81/177.8
6,745,650 B1 6/2004 Chang
6,895,839 B1 * 5/2005 Hsien ..... 81/177.8
2003/0015070 A1 * 1/2003 Chen ..... 81/177.9

* cited by examiner

*Primary Examiner*—Lee D. Wilson
*Assistant Examiner*—Alvin J. Grant
(74) *Attorney, Agent, or Firm*—Ladas & Parry

(57) ABSTRACT

A hand tool having an adjustable head comprises a head, a handle, a fastening device and a joint lock mechanism, characterised in that:

a bottom side of a concave pivotal portion of the handle has an inclining surface inclining forwardly from a first side of the concave pivotal portion to a second side of the concave pivotal portion; the joint lock mechanism comprises:

a first engaging device and a second engaging device; the second engaging device comprises a pull button and a biasing device. The pull button is moveable from an unlocked position at the first side of the concave pivotal portion to a locked position at the second side of the concave pivotal portion. The biasing device is disposed at a front end such that when the pull button is at an unlocked position, a gap is formed between a rear end of the pull button and the bottom side of the concave pivotal portion; when the pull button is at a locked position, a front end of the pull button is adapted to engage the first engaging device.

12 Claims, 6 Drawing Sheets

HAND TOOL HAVING A JOINT LOCK MECHANISM

BACKGROUND OF THE INVENTION

1. Field of the Invention

The present invention relates to a hand tool having a joint lock mechanism, especially a hand tool having a head of adjustable angles and allowing easier and more secure positioning. The present application claims priority based on ROC (Taiwan) Patent Application No. 093219593.

2. Description of the Related Art

U.S. Pat. No. 6,295,898, corresponding to TW421111, has disclosed an improved angle-adjustable wrench comprising a head and a handle. The head has a pivotal portion comprising a retaining area and an adjustment area disposed on the surface thereof and extending along the axis thereof. A stop member is disposed between the pivotal portion and a front side of the handle between two lugs thereof. The stop member has an engaging slot of an inverse U shape disposed at one side thereof and is adapted to cross over the front side of the handle between the two lugs and be moveable between the two lugs. A toothed portion is disposed on the other concave arced side thereof and is adapted to engage the retaining area of the head such that the stop member is moveable between the retaining area and the adjustment area so as to adjust and position the head to a certain angle more conveniently and securely.

However, U.S. Pat. No. 6,295,898 has the following defects: (1) the configuration of the retaining area and the adjustment area disposed at the pivotal portion of the head complicates processing "non-continuous" teeth of the convex portion; (2) the concave arced side of the stop member complicates processing teeth on the side and the precision is difficult to control; (3) in order to move the stop member to an "unlocked position" and ensure smooth pivoting between the head and the handle, a gap with a sufficient space between the stop member and the pivotal portion or the front side of the handle needs to be maintained, which in turn, results in adverse effects on the assembly of the wrench; (4) if the size of the gap is too small, the operation of adjusting will not be smooth when the stop member is moved from the "unlocked position" to a "locked position,"; (5) unless for other special designs, the engagement and positioning between a spring and a ball may be too loose when the stop member is moved to the "unlocked position"; (6) when the stop member is at the "locked position," the locking of the head is obviously unstable and the engagement between the retaining area and the toothed portion of the stopping member may be "loose" due to an inappropriate external force because the head is merely slightly pushed by a spring.

Another design of a wrench disclosed in U.S. Pat. No. 6,745,650 comprises an inclined cambered surface disposed at a convex portion of a head. A buckle which is a block is disposed between the head and a handle. One end of the buckle with respect to the head is formed with a concave arced surface to engage the cambered surface of the convex portion of the head. However, since there is no tooth disposed on the cambered surface of the convex portion, the locking between the convex portion and the buckle is much less effective. It is also very difficult and inconvenient to process teeth on the cambered surface and the concave arced surface, and the precision is hard to control. In addition, when the buckle is moved to an "unlocked position," a gap will be formed between the buckle and the convex portion, which has adverse effects on the assembly and operation of the wrench. Even if teeth were to be disposed on the cambered surface and the concave arced surface, the engagement between the buckle and the convex portion is not considered to be ideal and therefore is not easy to operate because the buckle is not pushed by any elastic force at the "unlocked position."

From the above, it is necessary for the industry to provide a hand tool having an adjustable head with a joint lock mechanism, which offers convenient and secure angle adjustment and positioning and can overcome the defects mentioned in the prior art.

SUMMARY OF THE INVENTION

It is an object of the present invention to provide a hand tool having a joint lock mechanism, and allowing easier and more secure positioning.

To achieve the above purposes, the present invention provides a hand tool comprising a head, a handle, a fastening device and a joint lock mechanism. The head has a convex pivotal portion and the handle has a concave pivotal portion adapted to be pivotally coupled to the convex pivotal portion. The concave pivotal portion has a first side, a second side opposite to the first side, and a bottom side coupled to the first side and the second side. The convex pivotal portion and the bottom side of the concave pivotal portion define a receiving space. The joint lock mechanism is disposed between the convex pivotal portion and the concave pivotal portion, characterised in that:

The bottom side of the concave portion has an inclining surface inclining forwardly from the first side to the second side. The joint lock mechanism comprises a first engaging device disposed at the convex pivotal portion and a second engaging device. The second engaging device comprises a pull button and a biasing device. The pull button is received in the receiving space and moveable from an unlocked position at the first side of the concave pivotal portion to a locked position at the second side thereof. The biasing device is disposed at the front end of the handle and protrudes from the bottom side of the concave pivotal portion. When the pull button is at the unlocked position, the biasing device is adapted to provide the pull button with a forward force such that a gap is formed between a rear end of the pull button and the bottom side of the concave pivotal portion. When the pull button is at the locked position, the biasing device is adapted to provide the pull button with a stopping force such that the pull button is prevented from moving freely back to the unlocked position, and a front end of the pull button is adapted to engage the first engaging device.

Other objects, advantages and novel features of the present invention will be drawn from the following detailed description of preferred embodiments of the present invention with the accompanying drawings, in which:

DESCRIPTIONS OF THE DRAWINGS

DETAILED DESCRIPTION OF THE INVENTION

Figure 1:
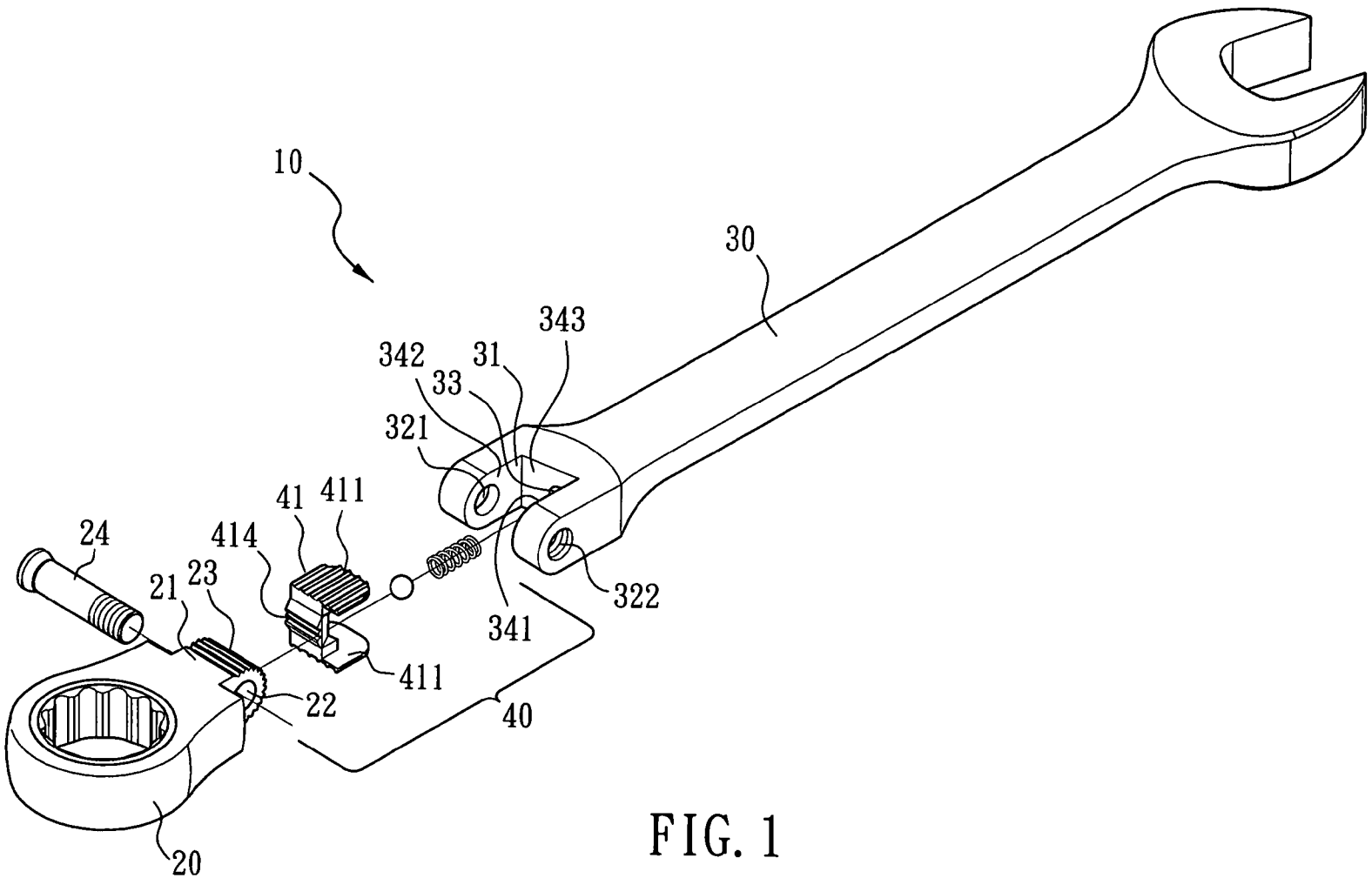
FIG. 1 illustrates an exploded view of a handle tool having a joint lock mechanism according to the present invention.

FIG. 1 illustrates an exploded view of a handle tool having a joint lock mechanism according to the present invention. A wrench 10 comprises a head 20, a handle 30 and a joint locking mechanism 40. A convex pivotal portion 21 is disposed at a rear end of the head 20 and a through hole 22 is formed through the convex pivotal portion 21. A concave pivotal portion 31 is disposed at a front end of the handle 30. The concave pivotal portion 31 has a first side 341 (referring to FIG. 9), a second side 342 opposite to the first side 341 (referring to FIG. 8) and a bottom side 343 coupled to the first side 341 and the second side 342. The bottom side 343 has an inclining surface inclining forwardly from the first side 341 to the second side 342 (referring to FIG. 8). A through hole 321 is formed at one side of the concave pivotal portion 31 while a screw hole 322 is formed at the other side thereof to receive a fastening device, preferably a screw 24, to pivotally couple the head 20 to the handle 30. The fastening device passes longitudinally through the concave pivotal portion 31 and the convex pivotal portion 21 along the axis thereof such that the concave pivotal portion 31 is pivotally coupled to the convex pivotal portion 21 while fixedly coupled to the concave pivotal portion 31. The convex pivotal portion 21 and the bottom side 343 of the concave pivotal portion 31 define a receiving space 35. Regarding the configuration between the screw 24, the through hole 321 and the screw hole 322, please refer to TW566274 for more details.

Figure 2:
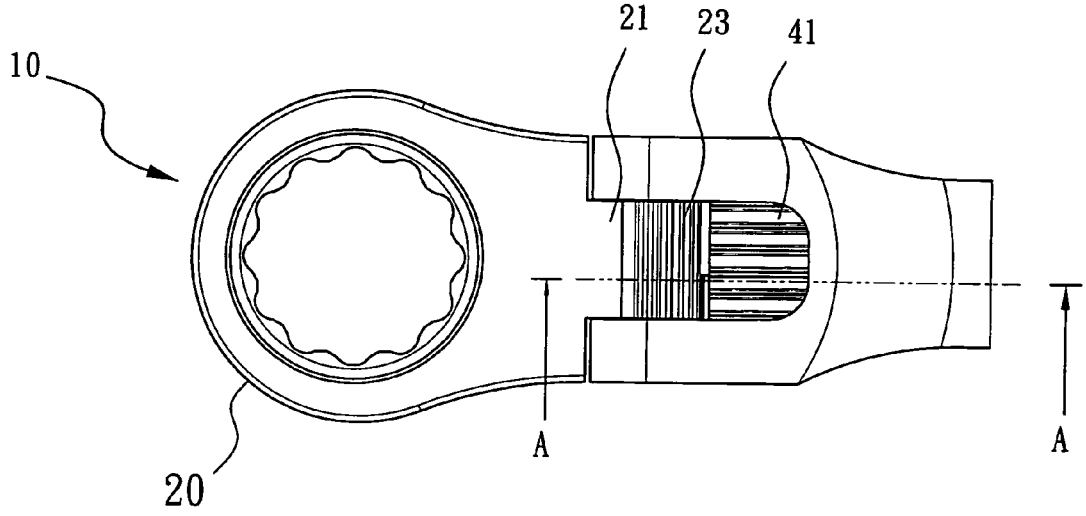
FIG. 2 illustrates a locally enlarged plan view thereof showing a pull button at a locked position and a head at a locked state.

Now referring to FIG. 1, the joint lock mechanism 40 is disposed between the convex pivotal portion 21 and the concave pivotal portion 31 and comprises a first engaging device and a second engaging device. The first engaging device is disposed at the convex pivotal portion 21 and preferably has a plurality of teeth 23 disposed equidistantly along the surface of the convex portion 21. Preferably, the teeth 23 extend along the axis of the through hole 22. Generally, the convex pivotal portion 21 has a substantially arced surface, and is provided with for example, twelve teeth 23 thereon such that the angle between two adjacent teeth is 15°. The second engaging device comprises a pull button 41 and a biasing device. The pull button 41 having a front end and a rear end is received in the receiving space 35 and is moveable from an unlocked position at the first side 341 of the concave pivotal portion 31 (referring to FIG. 3) to a locked position at the second side 342 thereof (referring to FIG. 2).

Figure 4:
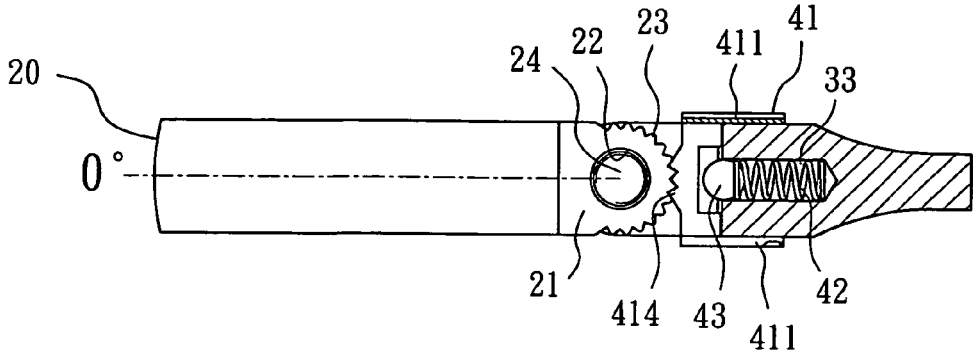
FIG. 4 illustrates a sectional view thereof along line A—A in FIG. 2 showing the head rotated by 0° with respect to a handle (not rotated)

Preferably, the front end of the pull button 41 is a flat surface, and at least one engaging portion 414, preferably with a double-toothed configuration, is disposed at the flat surface such that the at least one engaging portion 414 engages one of the plurality of teeth 23. The biasing device is disposed at the front end of the handle 30 and protrudes from the bottom side 343 of the concave pivotal portion 31. Preferably, the biasing device protrudes from a point of the bottom side 343 that is in proximity to the first side 341 (referring to FIG. 8). A blind hole 33 is formed longitudinally at the front end of the handle 30 from the bottom side 343 of the concave pivotal portion 31. The biasing device comprises a spring 42 and a ball 43. The spring 42 is received in the blind hole 33 and the ball 43 is adapted to be disposed at one end of the spring 42 and slightly protrudes from an opening of the blind hole 33 (referring to FIG. 8). When the pull button 41 is at the unlocked position, the biasing device is adapted to provide a forward force to the pull button 41 such that a gap 344 is formed between the rear end of the pull button 41 and the bottom side 343 of the concave pivotal portion 31 (referring to FIG. 9). When the pull button 41 is at the locked position, the biasing device is adapted to provide the pull button 41 with a stopping force such that the pull button 41 is prevented from moving freely back to the unlocked position (referring to FIG. 8), and the engaging portion 414 of the pull button 41 is adapted to engage one of the plurality of teeth 23 (referring to FIG. 4), while the rear end of the pull button 41 is adapted to abut against the bottom side 343 of the concave pivotal portion 31 (referring to FIG. 8).

Figure 8:
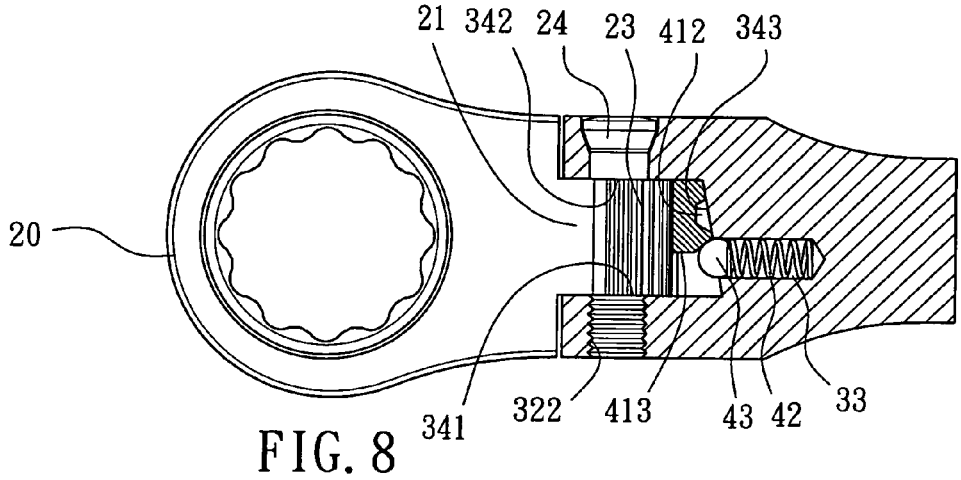
FIG. 8 illustrates a sectional view thereof along line C—C in FIG. 7 showing the pull button at the locked position.
Figure 9:
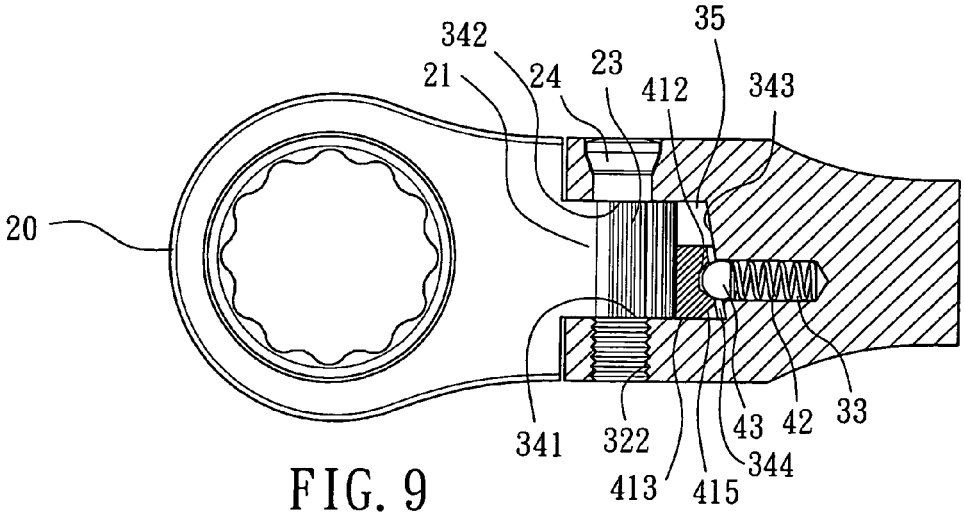
FIG. 9 illustrates a sectional view thereof along line C—C in FIG. 7 showing the pull button at the unlocked position.
Figure 10:
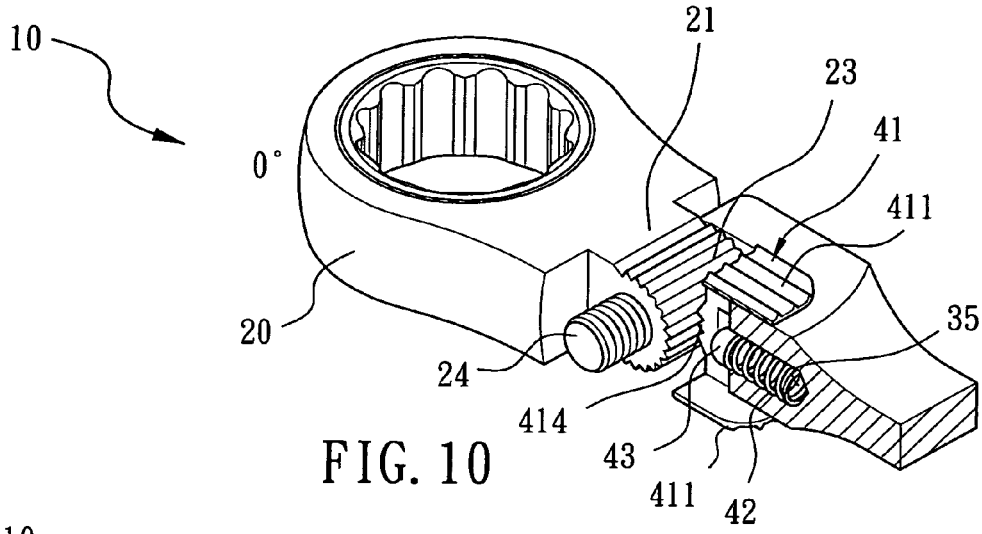
FIG. 10 illustrates a locally enlarged sectional view thereof showing the pull button at the locked position and the head rotated by 0° with respect to the handle (not rotated)

Referring to FIG. 9, the pull button 41 is formed with a recess 412 at the rear end thereof such that when the pull button 41 is at the unlocked position, the ball 43 of the biasing device is adapted to be pushed to engage the recess 412 by the forward force provided by the spring 42. Referring to FIG. 8, the pull button 41 can have an inner side surface 413 such that when the pull button 41 is at the locked position, the pull button 41 is prevented from moving freely back to the unlocked position by the ball 43 pushed by the stopping force provided by the spring 42 against the inner side surface 413. Preferably, the pull button 41 can further include a stopping surface 415 extending backwards from the inner side surface 413 such that when the pull button 41 is at the locked position, the pull button 41 is effectively prevented from moving freely back to the unlocked position by the ball 43 pushed by the stopping force provided by the spring 42 against the stopping surface 415. Also, the ball 43 can be easily moved over the stopping surface 415 when a user pushes the pull button 41 to the unlocked position. In addition, the pull button 41 can further comprise two pull tabs 411 opposite each other, and each of the pull tabs 411 has a rough surface (referring to FIG. 1) such that the user is provided with enough frictional force to operate the pull button 41. Each of the pull tabs 411 is coupled to an upper end and a lower end of the pull button 41, respectively, and partially covers opposite surfaces of the front end of the handle 30 (referring to FIG. 2).

Figure 3:
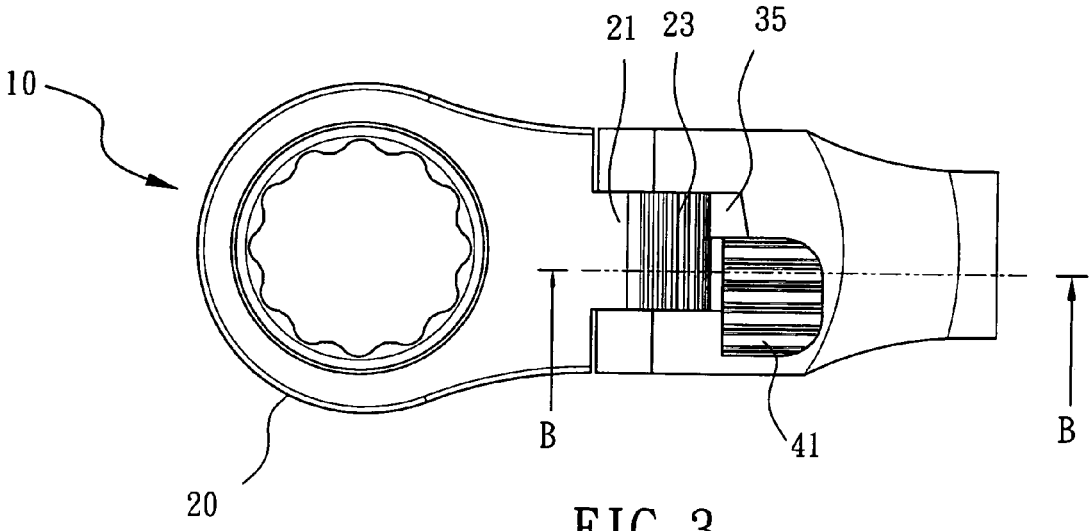
FIG. 3 illustrates a locally enlarged plan view thereof showing the pull button at an unlocked position and the head at an unlocked state.
Figure 5:
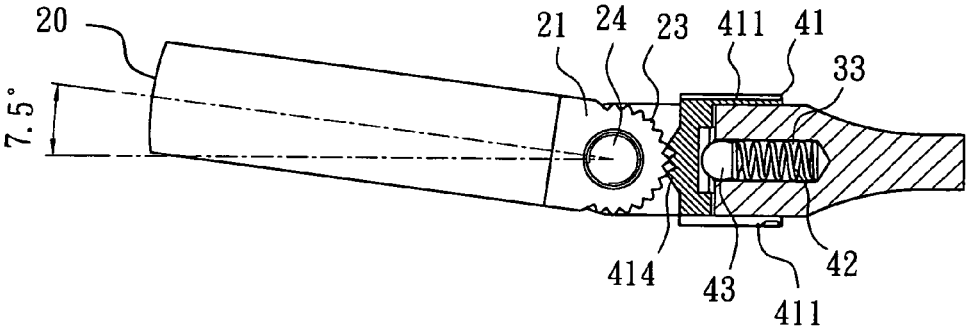
FIG. 5 illustrates a sectional view thereof along line B—B in FIG. 3 showing the head rotating by 7.5° with respect to the handle.
Figure 6:
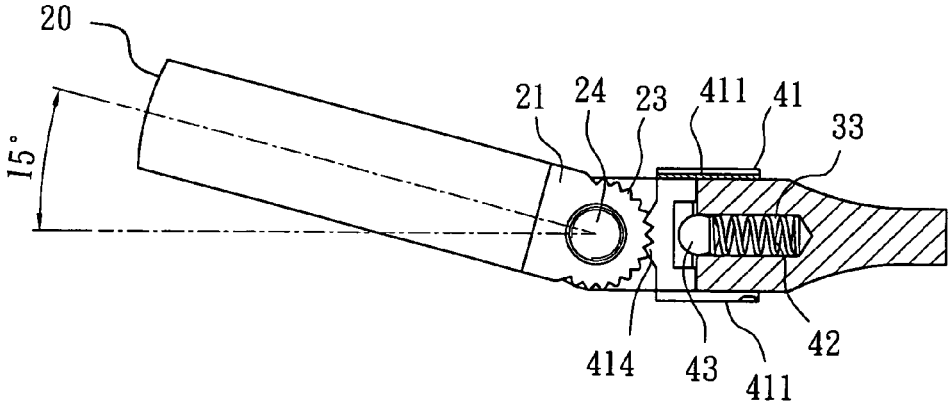
FIG. 6 illustrates a sectional view thereof along line A—A in FIG. 2 showing the head rotated by 15° with respect to the handle.
Figure 7:
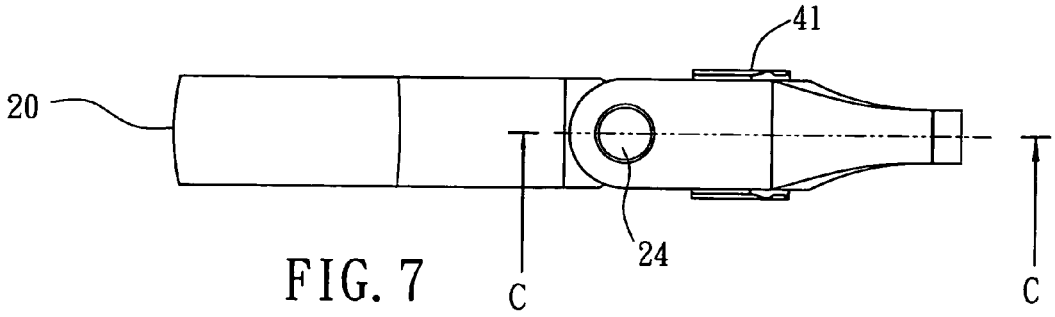
FIG. 7 illustrates a locally enlarged side view thereof.
Figure 11:
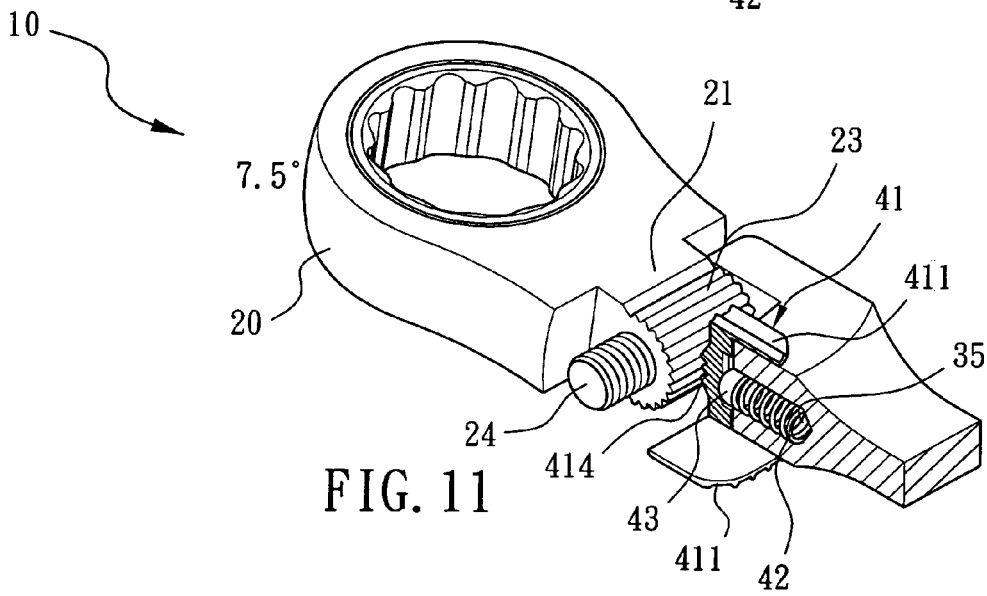
FIG. 11 illustrates a locally enlarged sectional view thereof showing the pull button at the unlocked position and the head rotated by 7.5° with respect to the handle.
Figure 12:
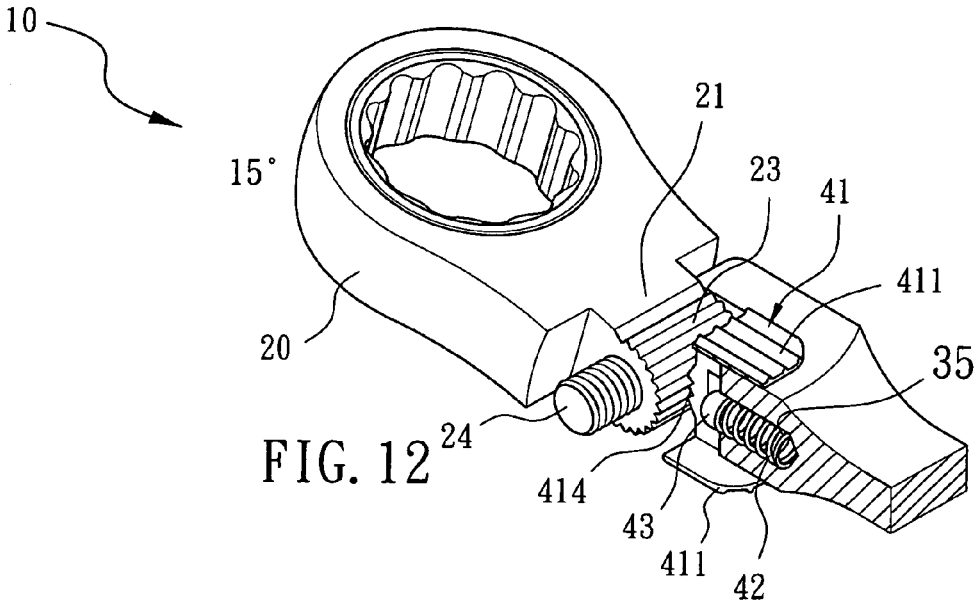
FIG. 12 illustrates a locally enlarged sectional view thereof showing the pull button at the locked position and the head rotated by 15° with respect to the handle.
Figure 13:
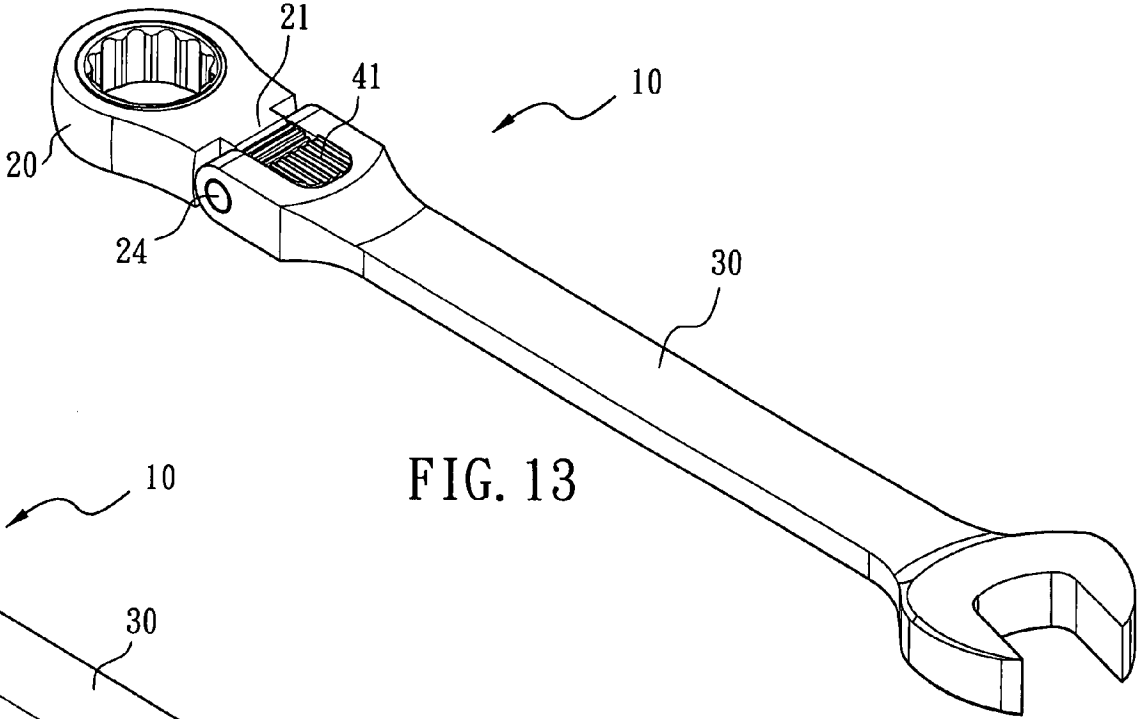
FIG. 13 illustrates a side view thereof.
Figure 14:
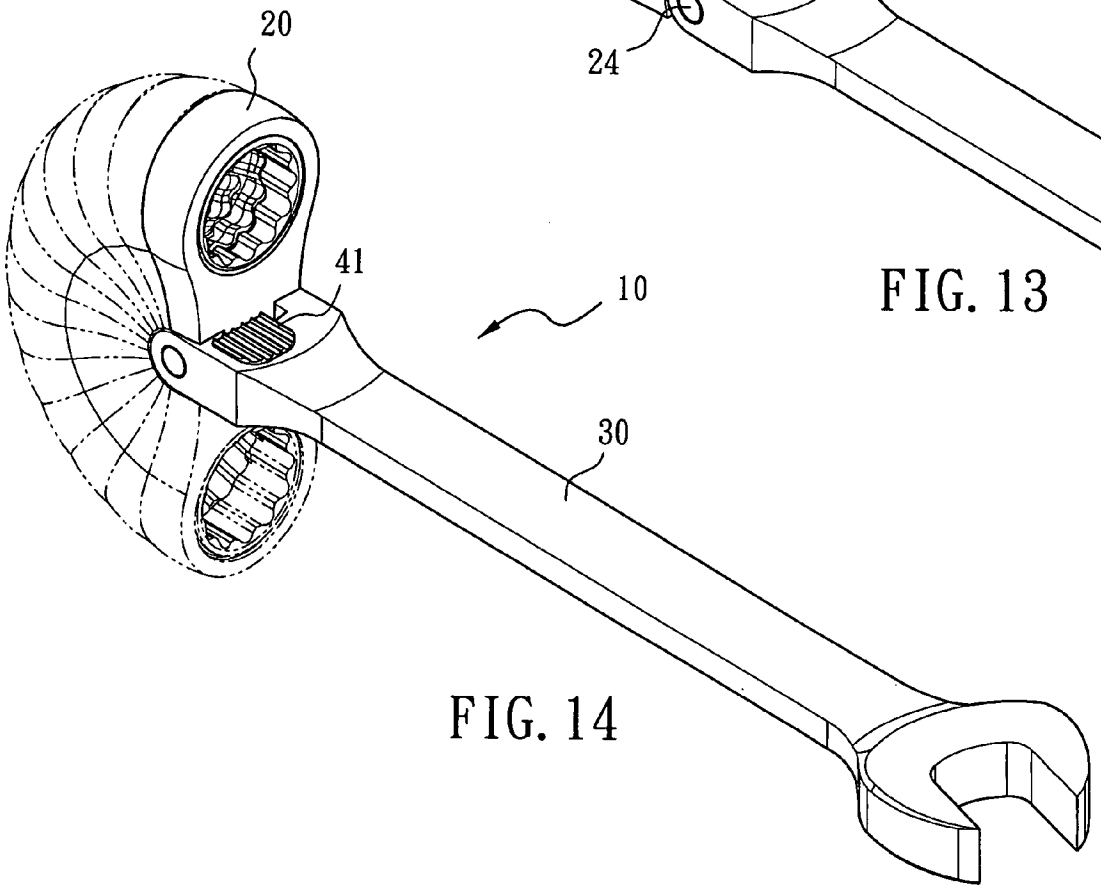
FIG. 14 illustrates the head rotated at multiple angles.

FIGS. 2 to 6 and 10 to 12 illustrate locally enlarged plan and side views of the hand tool according to the present invention, respectively. From FIGS. 2, 4 and 10, it can be seen that when the pull button 41 is at the locked position, the engaging portion 414 is adapted to engage one of the plurality of teeth 23 such that the head 20 can be rotated and secured to a predetermined angle (e.g., 0°) with respect to the handle 30, whereas the rear end of the pull button 41 is adapted to abut against the bottom side 343 of the concave pivotal portion 31 (referring to FIG. 8). As shown in FIGS. 3, 5 and 11, the pull button 41 can be moved by an external force to the unlocked position, whereas the head 20 can be pivotally rotated with respect to the handle 30 after the pull button 41 is moved. As shown in FIGS. 6 and 12, after the pull button 41 is moved, the head 20 can be pivotally rotated to another predetermined angle (e.g., 15°) with respect to the handle 30 and re-engage the pull button 41, whereas the pull button 41 can be moved to the locked position by external force such that the head 20 is secured to another predetermined angle and re-positioned. FIGS. 13 and 14 illustrate that the head 20 can be rotated with respect to the handle 30 at multiple angles.

From the above descriptions, it is apparent that the present invention provides a hand tool having an adjustable head with a joint lock mechanism and has easier and more secure positioning over the prior art. While the invention has been described in terms of several preferred embodiments, those skilled in the ait will recognise that the invention can still be practiced with modifications, within the spirit and scope of the appended claims.

What is claimed is:

1. A hand tool having a joint lock mechanism, comprising:

a head having a rear end, the rear end having a convex pivotal portion;

a handle having a front end, the front end having a concave pivotal portion pivotally coupled to the convex pivotal portion, the concave pivotal portion having a first side, a second side opposite to the first side, and a bottom side coupled to the first side and the second side;

a fastening device disposed through the convex pivotal portion and the concave pivotal portion and pivotally coupled to the convex pivotal portion while fixedly coupled to the concave pivotal portion, the convex pivotal portion and the bottom side of the concave pivotal portion defining a receiving space; and a joint lock mechanism disposed between the convex pivotal portion and the concave pivotal portion, characterised in that:

the bottom side of the concave pivotal portion has an inclining surface inclining forwardly from the first side to the second side;

the joint locking mechanism comprises:

a first engaging device disposed at the convex pivotal portion; and a second engaging device, comprising;

a pull button having a front end and a rear end and received in the receiving space and moveable from an unlocked position at the first side to a locked position at the second side; and a biasing device disposed at the front end of the handle and protruding from the bottom side of the concave pivotal portion;

when the pull button is at the unlocked position, the biasing device is adapted to provide the pull button with a forward force such that a gap is formed between the rear end of the pull button and the bottom side of the concave pivotal portion; when the pull button is at the locked position, the biasing device is adapted to provide the pull button with a stopping force such that the pull button is prevented from moving back to the unlocked position, and the front end of the pull button is adapted to engage the first engaging device.

2. The hand tool according to claim 1, wherein the convex pivotal portion has a substantially arced surface, and the first engaging device has a plurality of teeth disposed equidistantly along the arced surface of the convex pivotal portion; the front end of the pull button is a flat surface and at least one engaging portion is disposed at the flat surface such that the at least one engaging portion engages one of the plurality of teeth.

3. The hand tool according to claim 2, wherein when the pull button is at the locked position, the rear end of the pull button abuts against the bottom side of the concave pivotal portion.

4. The hand tool according to claim 3, wherein the biasing device protrudes from a point of the bottom side of the concave pivotal potion that is in proximity to the first side of the concave pivotal portion.

5. The hand tool according to claim 4, wherein a blind hole is formed longitudinally at the front end of the handle at the bottom side of the concave pivotal portion; the biasing device comprises a spring received in the blind hole and a ball disposed at one end of the spring and slightly protruding from an opening of the blind hole.

6. The hand tool according to claim 5, wherein a recess is formed at the rear end of the pull button such that when the pull button is at the unlocked position, the ball of the biasing device is adapted to be pushed to engage the recess by the forward force provided by the spring.

7. The hand tool according to claim 6, wherein the pull button has an inner side surface such that when the pull button is at the locked position, the pull button is prevented from movinge freely back to the unlocked position by the ball pushed by the stopping force provided by the spring against the inner side surface.

8. The hand tool according to claim 6, wherein the pull button has an inner side surface and a stopping surface extending backwards from the inner side surface such that when the pull button is at the locked position, the pull button is prevented from moving back to the unlocked position by the ball pushed by the stopping force provided by the spring against the stopping surface.

9. The hand tool according to claim 7, wherein the front side of the handle has two opposite surfaces, and the second engaging device further comprises two opposite pull tabs respectively coupled to an upper end and a lower end of the pull button and partially covering the opposite surfaces of the front end of the handle.

10. The hand tool according to claim 8, wherein the front side of the handle has two opposite surfaces, and the second engaging device further comprises two opposite pull tabs respectively coupled to an upper end and a lower end of the pull button and partially covering the opposite surfaces of the front end of the handle.

11. The hand tool according to claim 9, wherein each of the pull tabs has a rough surface which provides enough frictional force to operate the pull button.

12. The hand tool according to claim 10, wherein each of the pull tabs has a rough surface which provides enough frictional force to operate the pull button.

* * * * *